US009895282B2

(12) United States Patent
Butters et al.

(10) Patent No.: US 9,895,282 B2
(45) Date of Patent: Feb. 20, 2018

(54) EXERCISE AND GAIT-TRAINING APPARATUS

(75) Inventors: Jonathan Andrew Butters, Liverpool (GB); James William Bevington, Stoke-on-Trent (GB)

(73) Assignee: MOROW LIMITED, Liverpool, Merseyside (GB)

( * ) Notice: Subject to any disclaimer, the term of this patent is extended or adjusted under 35 U.S.C. 154(b) by 1274 days.

(21) Appl. No.: 13/825,254

(22) PCT Filed: Mar. 29, 2011

(86) PCT No.: PCT/GB2011/000473

§ 371 (c)(1),
(2), (4) Date: Jul. 1, 2013

(87) PCT Pub. No.: WO2012/049442

PCT Pub. Date: Apr. 19, 2012

(65) Prior Publication Data

US 2013/0274640 A1 Oct. 17, 2013

(30) Foreign Application Priority Data

Oct. 11, 2010 (GB) ..... 1017029.8

(51) Int. Cl.

| | |
|---|---|
| ***A61H 3/00*** | (2006.01) |
| ***A61H 3/04*** | (2006.01) |
| ***A61H 1/02*** | (2006.01) |

(52) U.S. Cl.

CPC ..... *A61H 3/008* (2013.01); *A61H 1/0244* (2013.01); *A61H 1/0262* (2013.01); (Continued)

(58) Field of Classification Search

CPC ..... A61H 3/008; A61H 3/04; A63B 23/0423; A63B 23/0424

See application file for complete search history.

(56) References Cited

U.S. PATENT DOCUMENTS 6,666,831 B1 12/2003 Edgerton et al.
6,689,075 B2 * 2/2004 West ..... A61F 5/0102 482/69

(Continued)

FOREIGN PATENT DOCUMENTS

WO 2008096210 A1 8/2008
WO 2009082249 A2 7/2009

OTHER PUBLICATIONS

International Search Report for corresponding International Application No. PCT/GB2011/000473.

*Primary Examiner* — LaToya M Louis
(74) *Attorney, Agent, or Firm* — Egbert Law Offices, PLLC

(57) ABSTRACT

An exercise and gait-training apparatus has a framework adapted for location above a surface, a harness adapted to support a person relative to the framework, an orthosis adapted for attachment to a lower leg or foot of one leg of the person, a first pair of actuators that are angled with respect to one another and pivotally connected to the framework and connected on a common pivot axis to the harness, a second pair of actuators that are angled with respect to one another and pivotally connected to the framework and connected on a common pivot axis to the orthosis, and a controller that is adapted to control and to synchronize operation of the actuators such that the leg is moved in an arcing pathway simulating a natural movement of the leg.

19 Claims, 5 Drawing Sheets

(52) U.S. Cl.
CPC ..... *A61H 1/0266* (2013.01); *A61H 3/00* (2013.01); *A61H 3/04* (2013.01); *A61H 2201/0192* (2013.01); *A61H 2201/1207* (2013.01); *A61H 2201/1215* (2013.01); *A61H 2201/163* (2013.01); *A61H 2201/164* (2013.01); *A61H 2201/165* (2013.01); *A61H 2201/1642* (2013.01); *A61H 2201/1652* (2013.01); *A61H 2201/1676* (2013.01); *A61H 2201/5043* (2013.01); *A61H 2201/5061* (2013.01)

(56) References Cited

U.S. PATENT DOCUMENTS

| | | | | |
|---|---|---|---|---|
| 7,041,069 | B2 * | 5/2006 | West | A61H 1/0237 601/35 |
| 8,075,453 | B1 * | 12/2011 | Wilkinson | A63B 21/00069 482/51 |
| 2002/0026130 | A1 | 2/2002 | West | |
| 2004/0019304 | A1 | 1/2004 | West | |
| 2005/0101448 | A1 | 5/2005 | He et al. | |
| 2006/0009332 | A1 * | 1/2006 | Jones | A61H 1/0255 482/54 |
| 2006/0040798 | A1 * | 2/2006 | Weier | A63B 22/02 482/54 |
| 2009/0298653 | A1 * | 12/2009 | Rodetsky | A61H 3/04 482/69 |

* cited by examiner

EXERCISE AND GAIT-TRAINING APPARATUS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an exercise and gait-training apparatus primarily but not exclusively for use in the rehabilitation of disabled persons, such as the victims of strokes, spinal injuries or the like who suffer from impaired mobility. However, it is expected that sonic embodiments of the apparatus may also be suitable for use by sportspersons who wish to correct or alter their gait to improve their performance.

2. Description of Related Art Including Information Disclosed Under 37 CFR 1.97 and 37 CFR 1.98

Persons who have suffered spinal injuries or strokes or who have undergone surgery such as arthroplasty may require intensive therapy to enable them to stand, balance, walk and sit down. This type of rehabilitation is usually provided in healthcare institutions. Conventional apparatus for use in the rehabilitation of such persons is designed to exercise muscles and to aid a person to walk. However, it does not always require the user's legs to follow a pathway simulating a natural movement of the leg during walking. This can result in the user adopting a poor gait.

It is an object of the present invention to provide an exercise and gait-training apparatus which overcomes this disadvantage.

BRIEF SUMMARY OF THE INVENTION

According to the present invention there is provided an exercise and gait-training apparatus comprising:

a framework adapted for location above a surface;

a harness adapted to support a person relative to the framework;

an orthosis adapted for attachment to a lower leg or a foot of one leg of said person;

a first pair of first actuators connected to the framework and to the harness whereby one side of the harness is moved, to move a hip or a thigh of said one leg of said supported person relative to the framework;

a second pair of first actuators connected to the framework and to the orthosis whereby the orthosis is moved relative to the framework; and control means adapted to control and to synchronize operation of the actuators such that the first leg is moved in a pathway simulating a natural movement of the leg during one of a walking, a running or a sporting activity.

It will be appreciated that an apparatus in accordance with the present invention may be used not only by persons with impaired mobility to exercise and to improve their gait but also by sportspersons who wish to train their legs to follow predetermined pathways to improve their performance.

Preferably, the framework is provided with wheels in order that it can roll over a floor surface. However, in a first alternative embodiment the framework is connected to a machine comprising an endless conveyor surface on which the person can practise movement while supported by the support means, the control means being adapted to synchronize movement of the conveyor surface relative to operation of the actuators. In a second alternative embodiment, the harness is adapted to suspend the person above floor level whereby the first leg is moved in the pathway either without the foot touching the floor or with the foot gliding over the floor.

Preferably also, the framework is provided with rear wheels, each driven by a first motor controlled by the control means. Advantageously, a feedback system is linked to the control means whereby control of the actuators and any driven wheels is responsive to movement of said person using the apparatus and/or the floor surface.

Preferably also, a second orthosis is provided for attachment to a lower leg or foot of the other leg of said person and pairs of second actuators identical to the first and second pairs of the first actuators are provided to move the other side of the harness and the second orthosis relative to the framework, the control means being adapted to control and to synchronize operation of all the actuators such that both legs of the person are moved in pathways simulating their natural movement during one of a walking, a running or a sporting activity.

Preferably also, a lever is connected to the control means and operable by said person to control the speed of operation of the actuators.

Preferably also, the lever comprises a joystick that controls the speed and direction of the wheels.

Preferably also, the actuators in each second pair of actuators are pivotally connected to their respective orthosis along a common pivot axis.

Preferably also, the harness is detachable from each first pair of actuators so that it can be fitted to said person prior to connection of each first pair of actuators thereto and said control means is adapted to move each first pair of actuators after connection to the harness to move said person from a seated into a standing position along a pathway simulating a natural standing movement prior to operation of the actuators to simulate natural movement of one or both legs during said walking, running or sporting activity.

Further preferred but non-essential features of the various aspects of the present invention are further described in the dependent claims appended hereto.

BRIEF DESCRIPTION OF THE DRAWINGS

Embodiments of the present invention will now be described by way of example with reference to the accompanying drawings, in which.

DETAILED DESCRIPTION OF THE INVENTION

Figure 1:
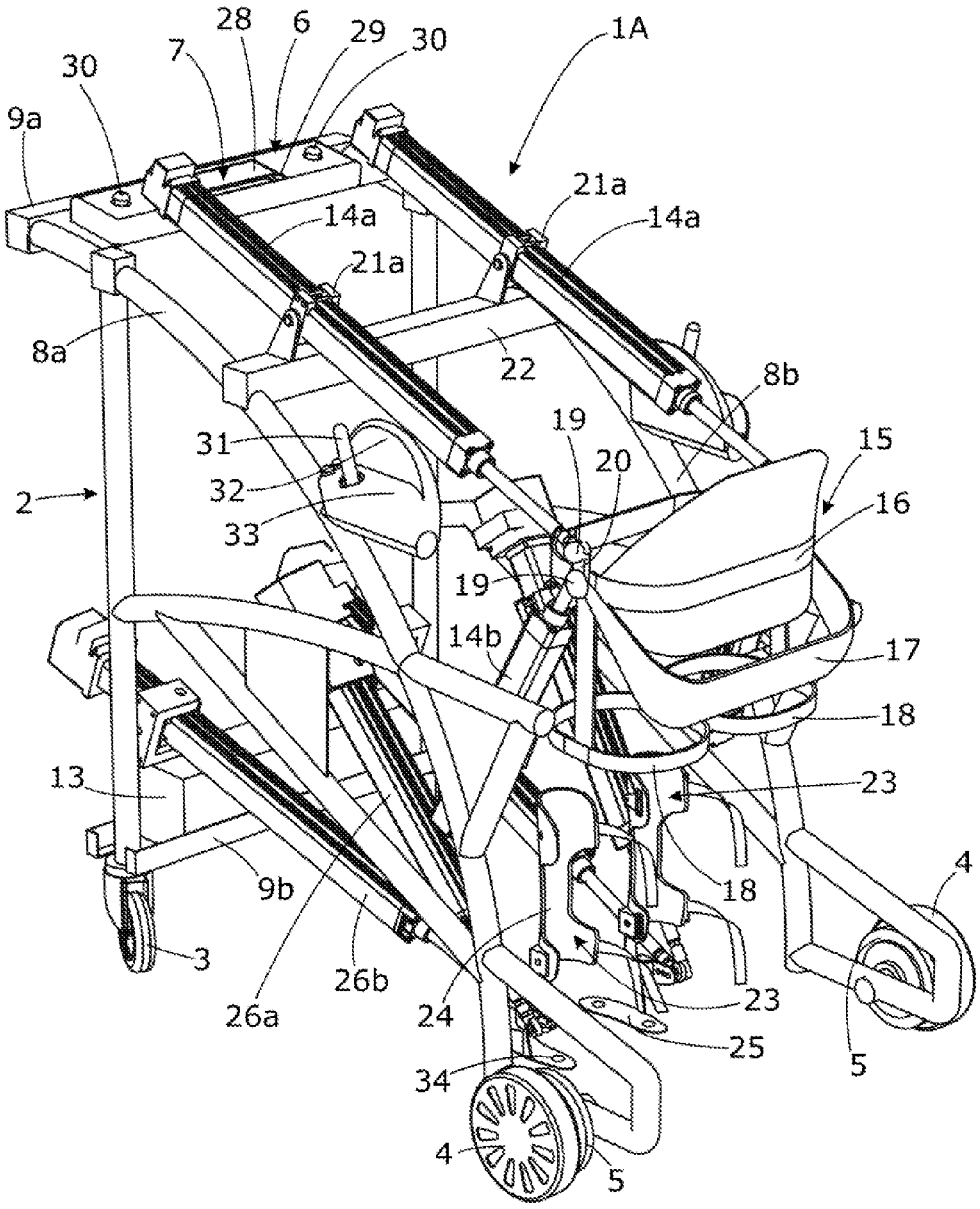
FIG. 1 is a perspective view from the rear and one side of a first embodiment of an exercise and gait-training apparatus in accordance with the present invention.
Figure 2:
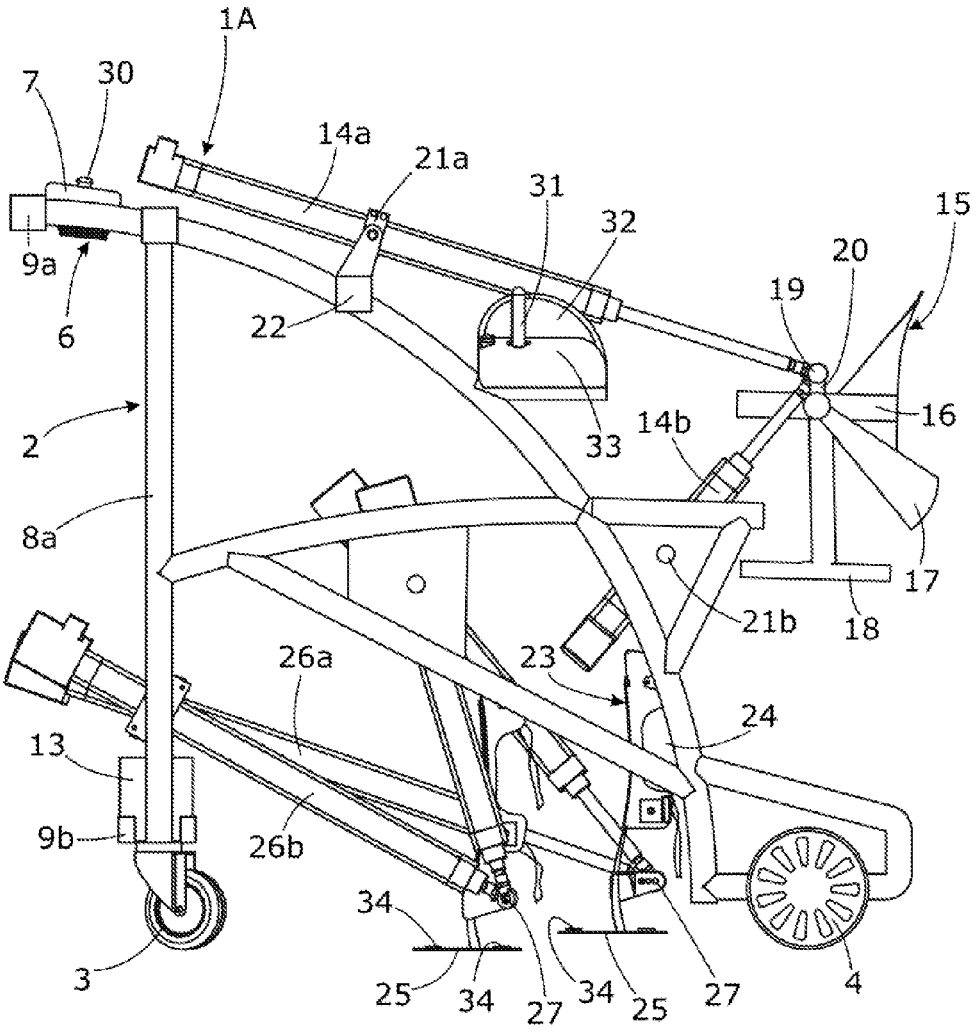
FIG. 2 is a side elevation of the apparatus shown in FIG. 1.
Figure 3:
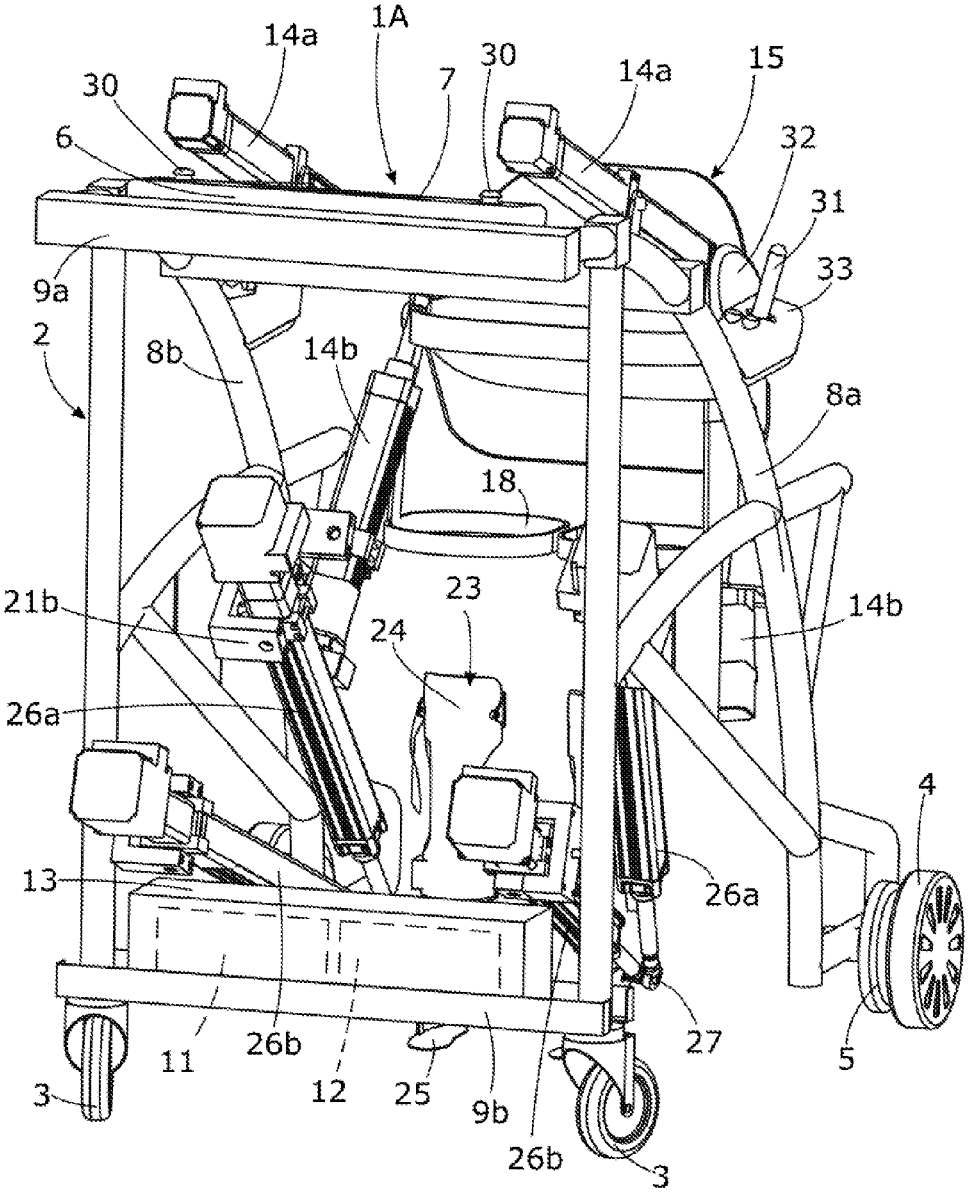
FIG. 3 is a perspective view from the front and one side of the apparatus shown in FIGS. 1 and 2.
Figure 4:
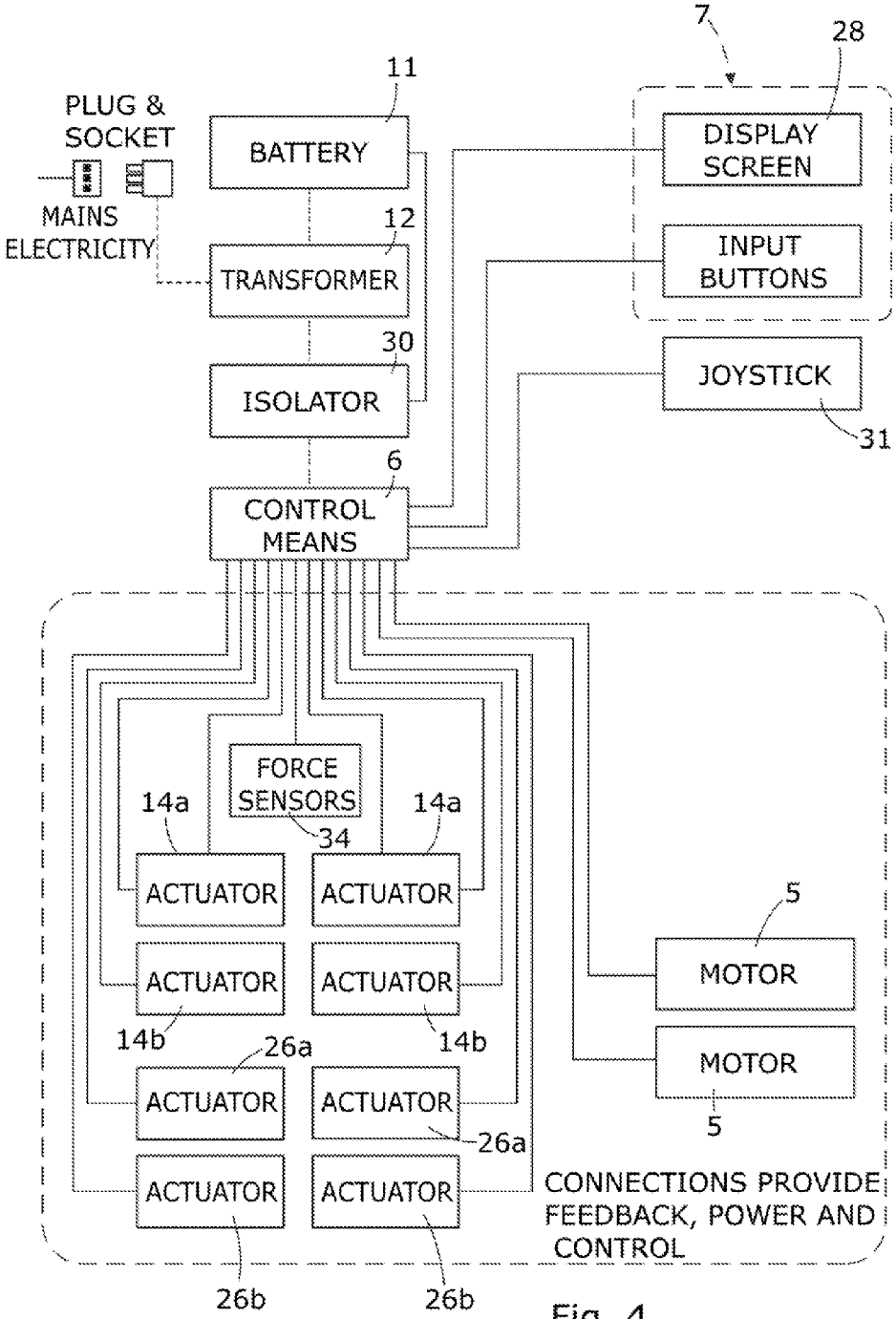
FIG. 4 is a block diagram showing operation of the apparatus shown in FIGS. 1 to 3 by a control means of the apparatus.
Figure 5:
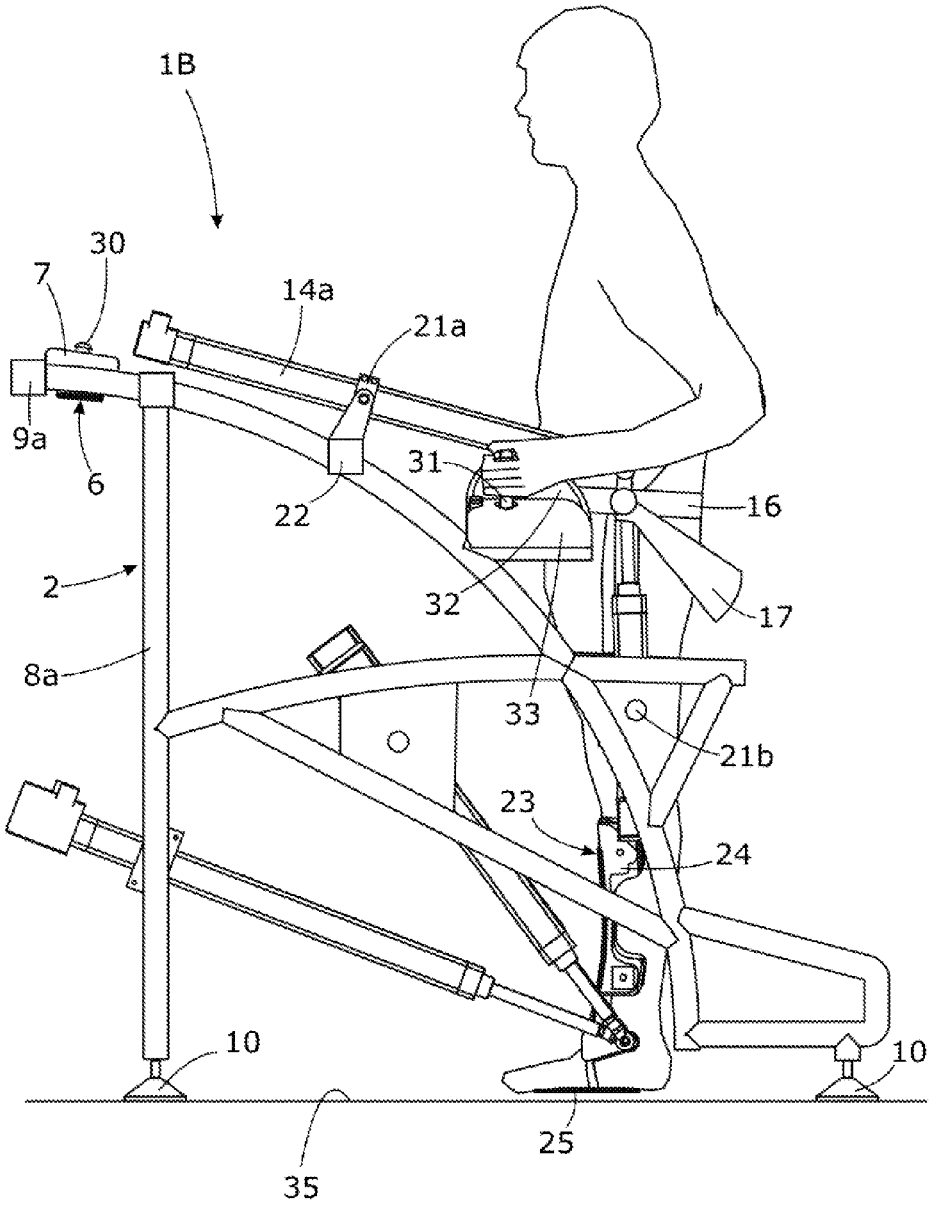
FIG. 5 is a side elevation similar to FIG. 2 but of a second embodiment of the apparatus in accordance with the present invention and showing a user of the apparatus attached to it.

The embodiments of apparatus 1A and 1B shown in the drawings comprise exercise and gait-training apparatus suitable for use in the rehabilitation of disabled persons. The first embodiment 1A shown in FIGS. 1 to 4 provides both a means of exercising the legs and a limited form of mobility to enable a user to move around in a controlled environment inside a building and possibly also, to a more limited extent, outside. The second embodiment of apparatus 1B shown in FIG. 5 is similar to the first embodiment but is static. In the drawings the parts of both apparatus that are identical or that have similar functions have been given the same reference number.

In both embodiments the apparatus 1A, 1B comprises a framework 2. The apparatus 1A is provided with front and rear pairs of wheels 3, 4, the front wheels 3 being caster wheels and the rear wheels 4 being drivable by adjacent motors 5 under the control of a control means 6. The motors 5 are fined with a brake system for safety. In the apparatus 1B, there are no wheels but a control means 6 is still provided as this control the operation of the apparatus 1A, 1B as a whole. The control means 6 is located at the front of the framework 2 in combination with a user interface means 7, as is described in more detail below.

The framework 2 comprises two vertical side frames 8*a* and 8*b* respectively alai are connected at the front of the apparatus 1 by crosspieces 9*a* and 9*b* at top and bottom respectively. The rear of the framework 2 is left open so that it can be positioned around a prospective user of the apparatus, who is likely to be seated, for example in a wheelchair.

In the first embodiment of apparatus 1A, the front caster wheels 3 are located at the joint between the crosspiece 9*b* and the side frames 8*a*, 8*b*. The rear wheels 4 and their motors 5 are secured to small framework extensions at the bottom, rear of the frames 8*a* and 8*b* respectively. In the second embodiment of apparatus 1B, the framework 2 is provided with adjustable feet 10 instead of but in the same positions as the wheels 3, 4.

Secured between the frames 8*a* and 8*b* to the upper crosspiece 9*a*, which in the present embodiments is integrally formed with parts of the side frames 8*a* and 8*b* in a U-shaped arrangement, is the control means 6 and the user interface means 7. The crosspiece 9*b* forms a tray on which is located a rechargeable battery pack 11 and a transformer 12 beneath a cover 13. The battery pack 1 powers the apparatus 1 and the transformer 12 enables it to be recharged via a mains electricity supply. The battery pack 11 and the transformer 12 are mounted low down at the front of the apparatus 1 to provide provides stability and to counterbalance the apparatus 1 when the user is being raised and lowered, as described below, or if the user should stumble or lean over during use. In some embodiments, the apparatus 1 may be powered directly, via the transformer 12, by mains electricity. This method of providing power is more appropriate for static embodiments of the apparatus 1B as shown in FIG. 5.

As the illustrated embodiments of the apparatus 1A and 1B are designed to exercise either or both legs of a user, they are symmetrical about a central, front-rear axis. Hence, in the following description where two pairs of actuators are described, it is to be understood that one of the pairs is located on one side of the apparatus 1A, 1B and the other of the pairs is located on the opposite side of the apparatus 1A, 1B. Both pairs have the same configuration and carry out the sane function. The actuators themselves are provided in pairs so that by coordinating operation of the actuators, movement of the parts of the apparatus 1A, 1B to which they are connected (as described below) can follow an arcing rather than a linear pathway. This is important as it enables the apparatus 1A, 1B to mimic a natural gait wherein movement of the hips and upper and lower legs of a user of the apparatus 1 follow a normal biomechanical pathway. In this regard, the control means 6 may be programmed to operate and to synchronize the pairs of actuators to suit individual users of the apparatus 1. The location and operation of the various pairs of actuators in the apparatus 1A, 1B will now be described.

Mounted between the side frames 8*a* and 8*b* at the rear of the apparatus 1A, 1B by two pairs of first actuators 14*a*, 14*b* is a harness 15 for supporting a user of the apparatus 1. The pairs of actuators 14*a*, 14*b* are respectively located, at the sides of the harness 15 and their operation is controlled by the control means 6 so that they move their respective side of the harness 15 and thereby a hip or a thigh of one leg of a person supported by the harness 15 relative to the framework 2 in such a way as to assist the user's pelvis to assume the correct position when standing up, balancing, walking, stepping and sitting down. To accomplish this the harness 15 comprises a waist belt 16, a gluteal belt 17 and leg straps 18. The waist belt 16 is preferably a semi-rigid padded construction and can be fashioned to provide additional front, rear or side support (not shown) if required. This additional support may be formed integrally with the waist belt 6 or be attachable as one or more separate parts. The gluteal belt 17 has a concave inner form and is also a semi-rigid padded construction. The concave inner form is designed to fit snugly to the user's posterior so that it does not slide out of position during standing or sitting movements. The leg straps 18 are again semi-rigid padded constructions and are designed to prevent a user from slipping out of the harness when they are being supported in an upright position. All the parts of the harness 15 are adjustable so that they can be tightened around the user to fit snugly by means of suitable devices such as clips, buckles, and book and loop strips.

The harness 15 is detachably secured to the ends of the two pairs of first actuators 14*a*, 14*b* by quick release fasteners 19 to connection tabs 20 located at each side of the harness 15 adjacent the waist belt 16 and thereby above the level of the user's hips. The connection tabs 20 enable the actuators 14*a* and 14*b* to be connected to the harness 15 in close proximity to one another at this location. When not under load, the fasteners 19 allow the harness 15 to be readily and quickly detached from the rest of the apparatus 1. However, when under load the listeners 19 are preferably arranged to be more difficult to release in order to prevent an accidental separation during use of the apparatus 1. The fasteners 19 also allow the actuators 14*a*, 14*b* to pivot relative to the harness 15. The actuators 14*a*, 14*b* of the each pair are angled with respect to one another and are also connected intermediate their length to different parts of their respective frame 8*a*, 8*b* by pivotally mounted brackets 21*a* and 21*b* respectively. The brackets 21*a* are attached to a crosspiece 22 that is secured at its ends to the two frames 8*a* and 8*b* and that is located immediately in front of a user of the apparatus 1 when in a standing position.

Located beneath the harness 15 is a pair of orthoses 23 that are adapted for respective attachment to the lower legs of a user of the apparatus 1. Each orthosis 23 comprises a pad 24 designed to be connected to the lower leg by straps or other securing method and a footplate 25 that locates beneath the foot. The connection between the footplate 25 and the pad 24 may be hinged and the footplate 25 may be flexible so that it can flex to allow a user to bend their toes relative to the rest of the foot. Each orthosis 23 is mounted to the framework 2 by a second pair of actuators 26*a*, 26*b*. Ends of the actuators 26*a*, 26*b* are pivotally connected to their respective orthosis 23 by a common pivot pin 27 that permits rotation of the actuators 14*a*, 14*b* relative to the orthosis 23 about a common pivot axis. This is important as if ensures that movement of the orthosis 23 by the actuators 26*a*, 26*b* follows a natural pathway around a closed loop, which mirrors the pathway followed by an ankle of a healthy person when walking. The actuators 26*a*, 26*b* are angled with respect to one another and their other ends are pivotally mounted to different parts of the adjacent frame 8*a* or 8*b* by brackets 28. Operation of both pairs of actuators 26*a*, 26*b* is also controlled by the control means 6 in such a way that the user's legs and feet will move along a pathway simulating a natural movement during one of a walking, a running or a sporting activity. It will be appreciated that operation of all the actuators 14*a*, 14*b*, 26*a* and 26*b* on both sides of the apparatus 1 is controlled and synchronized by the control means 6 so that a user's hips, legs and feet are moved in harmony with one another along natural pathways. This exercises the patient's muscles and trains the body to move in a natural way.

At the same time as controlling operation of all the actuators, in the mobile first embodiment of the apparatus 1A, the control means 6 also drives the rear wheels 4 via the motors 5 either in unison or differentially to enable the apparatus 1 to move forwards, backwards and to turn. Operation of the motors 5 is synchronized with that of all of the actuators 14, 14*b*, 26*a*, 26*b* on both sides of the apparatus 1A by the control means 6 to assist the user to move relative to the ground in a natural way.

The user interface means 7 allows the user to control operation of the control means 6 and thereby the apparatus 1A, 1B as a whole. It comprises instrumentation and user input controls via a display screen 28 and user input buttons 29. In a modification, the screen 28 comprises a touch screen incorporating the functions of the buttons 29. The display screen 28 is adapted to display information concerned with the way the apparatus 1A, 1B is operating and operational settings. For safety reasons, an isolator button 30 allows the user or another person to switch off the power supply to the apparatus 1A, 1B quickly if necessary by instantly disconnecting the battery pack 11 and/or or transformer 12 from the control means 6. Preferably, the interface means 7 duplicates all buttons 29, 30 and on each side of the apparatus 1A, 1B so that they can be readily operated by a left or a right hand of the user so that the apparatus 1A, 1B can be readily used by stroke victims or other persons who have lost the use of limbs down one side of the body. In addition to the interface means 7, levers 31 are provided on each side of the apparatus 1A, 1B and linked to the control means 6 in order to provide the user control over the speed of operation of the actuators 14*a*, 14*b*, 26*a*, 26*b*, in mobile embodiments of the apparatus 1A, the levers 31 take the form of joysticks to enable the user to control the direction and speed of the rear wheels 4, which are operated in synchronism with the speed of the actuators 14*a*, 14*b*, 26*a*, 26 by the control means 6.

The levers or joysticks 31 are duplicated for the same reason as the buttons 29, 30 and are mounted on the frames 8*a*. 8*b* adjacent a hand grip 32 and arm rest 33 and close to the harness 15 for the convenience of the user. For safety and to prevent confusion, a user must decide prior to use of the apparatus 1A, 1B whether to use the buttons 29 and the lever or joystick 31 on the left or on the right of the apparatus 1A, 1B. This information is communicated to the control means 6 via the interface means 7 and the control means 6 then disables signals from the buttons 29 and the lever or joystick 31 on the other side of the apparatus 1A, 1B.

Preferably, the apparatus 1A, 1B incorporates a feedback system comprising, force sensors 34 mounted in the orthoses 23, preferably on the footplates 25, and in the actuators 14*a*, 14*b*, 26*a* and 26*b* on both sides of the apparatus 1. The force sensors 34 relay information relating to the pressure exerted by the user on the footplates 25 and the degree of resistance being offered by the user to the actuators 14*a*, 14*b*, 26*a* and 26*b* hack to the control means 6. This allows the control means 6 to respond to the movement of the user and to control all the actuators and, where applicable, the motors 5 appropriately, for example by reducing the speed of the motors 5 if the user starts walking well or by offering resistance to the user via the actuators 14*a*, 14*b*, 26*a* and 26*b* to force the user to use more muscle power to move. More generally, the feedback system allows the control means 6 to control operation of the apparatus 1A, 1B within a predetermined set of parameters, which may be programmed into the control means 6 via the interface means 7 for any individual user. The control means 6 may also record data relating to individual therapy sessions for analysis and evaluation by healthcare professionals. The control means 6 may also be programmed to act appropriately, for example to brake the motors 5 or to stop operation of the actuators 14*a*, 14*b*, 26*a* and 26*b* in certain circumstances, for example in the case of collision.

In use, the harness 15 is first fitted to the user and then the apparatus 1A, 1B is moved into position around the user, who is likely to be seated. The harness 15 is then secured to the ends of the two pairs of first actuators 14*a*, 14*b* by the quick release fasteners 19 at each side of the harness 15. The orthoses 23 are also secured to the user's lower legs. When the user is ready, the apparatus 1 can be switched on via the interface means 7 and the apparatus 1A, 1B activated, to raise the user into a standing position by the pairs of actuators 14*a*, 14*b*. The shape of the harness 15 and the location of the connection tabs 20 relative thereto, namely above the hips, enables this to be accomplished in a natural fashion, the harness 15 enabling the user's pelvis to following a natural trajectory wherein each hip is raised along, with the leg as the user picks up each foot from the floor prior to striding forward. During this part of the operation, in mobile embodiments of the apparatus 1A the control means 6 ensures that the rear wheels 4 are braked to prevent the framework 2 from rolling forwards.

Once the user is standing, the control means 6 can be signalled via the interface means 7 to commence a preprogrammed operation of all of the actuators 14*a*, 14*b*, 26*a*, 26*b* and, in mobile embodiments of the apparatus 1A, the motors 5 to move the user's legs along pathways simulating natural movement of the legs during one of a walking, a running or a sporting activity. As the user moves, the pairs of actuators 41*a*, 14*b* move in sequence under control of the control means 6 to move the user's pelvis and hips along a natural biomechanical pathway. Similarly the pairs of actuators 26*a*, 26*b* connected to the orthoses 23 are controlled in sequence with each other and synchronized with operation of the actuators 14*a*, 14*b* to move the users legs and feet in harmony with the pelvis and hips. In mobile embodiments of the apparatus 1A, the control means 6 also controls operation of the motors 5 to drive the wheels 4 either in unison or differentially to enable the apparatus 1A to move forwards, backwards and to turn. The user can control this and the acceleration and the speed of operation of the actuators 14*a*, 14*b*, 26*a*, 26*b* via the lever or joystick 31. Alternatively, the control means 6 can be programmed to follow a predetermined routine. This is particularly appropriate in static embodiments of the apparatus 1B.

In an alternative static embodiment of the apparatus, the framework may be arranged above the surface of an endless conveyor on which the user can practise walking. The speed and acceleration of the conveyor surface may be controlled by the lever 31 via the control means 6 or the control means 6 may be pre-programmed to follow a predetermined routine. In either case, the control means 6 synchronizes the movement and speed of the conveyor surface with operation of the actuators. Such an embodiment is particularly suited for training sportspersons as the conveyor may be accelerated up to appropriate running speeds, with the actuators 14*a*, 14*b*, 23*a*, 23*b* adjusting their operation in synchronism therewith. Such sportspersons may use the apparatus to correct their gait and to force their body to exercise in a particular way that they can then train themselves more to use. The control means 6 may also be programmed to move the actuators 14*a*, 14*b*, 23*a*, 23*b* to simulate appropriate pathways followed by the legs in various sporting manoeuvres, again for training purposes.

In the illustrated, static embodiment of the apparatus 1B shown in FIG. 5, the harness 15 substantially supports the weight of the user so that the user's feet either do not touch the floor or barely touch the floor so that they slide over it during use of the apparatus 1B. The footplates 25 of the orthoses 23 are therefore preferably provided with a smooth, undersurface in contrast to the surface use for mobile embodiments of the apparatus 1A where a rougher undersurface provides a better grip on the floor. Preferably, the floor surface 35 beneath the apparatus 1B is polished to offer less resistance to the sliding motion of the footplates 25. It will be appreciated that this embodiment is particularly suitable for use by disabled persons as the user does not have to support his or her own weight. However, it may also be used by sportspersons who want to exercise or correct the gait of only one leg or foot.

With regard to the latter comment, whilst in most cases it is expected that a user of the apparatus 1A, 1B will connect both legs to the orthoses 23. However, it is possible to adapt the apparatus 1A, 1B to operate on only one side of the body to assist movement of one leg only. This can be done by appropriate programming of the control means 6.

The invention claimed is:

1. An exercise and gait-training apparatus comprising:

a framework adapted for location above a surface;

a harness adapted to support a person relative to the framework;

an orthosis adapted for attachment to a lower leg or a foot of one leg of the person;

a first pair of first actuators that are angled with respect to one another and each pivotally connected at one end to said framework and at another end pivotally connected on a common pivot axis to one side of said harness whereby said one side of said harness is moved to move a hip or a thigh of the one leg of the supported person relative to said framework;

a second pair of first actuators that are angled with respect to one another and each pivotally connected at one end to said framework and at another end connected on a common pivot axis to said orthosis whereby the orthosis is moved relative to said framework; and a controller adapted to control and to synchronize simultaneous operation of said first pair of first actuators and said second pair of first actuators such that once the person is in a standing position a hip or a thigh of the one leg is moved along a natural biomechanical pathway by the first pair of first actuators at the same time as a lower leg or foot of the one leg is moved in an arcing pathway by said second pair of first actuators simulating a natural movement of the one leg during one of a walking, a running and a sporting activity.

2. The apparatus of claim 1, wherein said framework is provided with wheels so as to roll over a floor surface.

3. The apparatus of claim 2, wherein the wheels comprise rear wheels each driven by a motor controlled by said controller.

4. The apparatus of claim 3, wherein the motors are synchronized with the first and second pairs of first actuators by said controller.

5. The apparatus of claim 2, wherein the wheels comprise a pair of front caster wheels.

6. The apparatus of claim 1, wherein said framework is connected to a machine comprising an endless conveyor surface on which the person can practice movement while supported by said harness, said controller being adapted to synchronize movement of the conveyor surface with operation of said first and second pairs of first actuators.

7. The apparatus of claim 6, further comprising:

a lever connected to said controller and operable by the person to control speed of operation of said first and second pairs of first actuators, wherein the lever also controls speed and operation of the conveyor surface.

8. The apparatus of claim 1, wherein said framework and said harness are adapted to support the person above a floor whereby the one leg is moved in the pathway either without the foot touching the floor or with the foot adapted to slide over the floor.

9. The apparatus of claim 1, further comprising:

a lever connected to said controller and operable by the person to control a speed of operation of said first and second pairs of first actuators.

10. The apparatus of claim 9, wherein said lever comprises a joystick that also controls speed and direction of front caster wheels of said framework.

11. The apparatus of claim 1, wherein a second orthosis is provided for attachment to a lower leg or foot of the other leg of said person and first and second pairs of second actuators identical to the first and second pairs of first actuators are provided to move another side of said harness and the second orthosis relative to said framework, said controller being adapted to control and to synchronize operation of all the actuators such that both legs of the person are moved in pathways simulating their natural movement during the one of the walking, a running and a sporting activity.

12. The apparatus of claim 1, further comprising:

a feedback system linked to said controller whereby control of the actuators is responsive to movement of the person.

13. The apparatus of claim 12, wherein the feedback system comprises force sensors mounted in said orthosis and in the actuators.

14. The apparatus of in claim 1, wherein said orthosis comprises a leg pad for securement to the lower leg and a footplate for location beneath the foot of the person.

15. The apparatus of claim 1, wherein said harness comprises a waist belt, a gluteal belt and leg straps.

16. The apparatus of claim 15, wherein each said first pair of actuators is connected to said harness adjacent to the waist belt.

17. The apparatus of claim 1, wherein said harness is detachable from each of the first pair of actuators so that it can be fitted to the person prior to connection of each first pair of actuators thereto and said controller is adapted to move each first pair of actuators after connection to said harness to move the person from a seated into a standing position along a pathway simulating a natural standing movement prior to operation of said first and second pairs of first actuators to simulate natural movement of one or both legs during the walking, running or sporting activity.

18. The apparatus of claim 1, wherein each of the first pair of actuators is detachably secured to said harness via a quick release fastener.

19. The apparatus of claim 1, wherein an isolator button is provided whereby a power supply to said controller can be instantly disconnected.

* * * * *